175-40 SR
3/25/86 OR 4,577,700

United States Patent [19]

Dellinger et al.

[11] Patent Number: 4,577,700

[45] Date of Patent: Mar. 25, 1986

[54] METHOD AND SYSTEM FOR DISPLACING DRILLING FLUID FROM A DRILL STRING IN A WELL DRILLING SYSTEM

[75] Inventors: Thomas B. Dellinger, Duncanville; William G. Boston, Dallas; James H. Sexton, Duncanville; Robert T. Strong, Plano, all of Tex.

[73] Assignee: Mobil Oil Corporation, New York, N.Y.

[21] Appl. No.: 600,698

[22] Filed: Apr. 16, 1984

[51] Int. Cl.[4] ..... E21B 19/00; E21B 21/10; E21B 47/04

[52] U.S. Cl. ..... 175/40; 175/65; 175/212; 175/217; 175/218

[58] Field of Search ..... 175/65, 66, 69, 71, 175/207, 212, 218, 40, 217, 48; 166/250, 65 R, 77.5

[56] References Cited

U.S. PATENT DOCUMENTS

| | | | |
|---|---|---|---|
| 2,120,132 | 6/1938 | Hawkins | 175/212 X |
| 2,595,715 | 5/1952 | Sloan | 175/212 X |
| 3,053,330 | 9/1962 | Arthur | 175/207 X |
| 3,889,959 | 6/1975 | Persson | 175/212 X |
| 4,162,473 | 7/1979 | Utasi | 175/40 X |
| 4,315,553 | 2/1982 | Stallings | 175/212 X |

*Primary Examiner*—Stephen J. Novosad
*Attorney, Agent, or Firm*—A. J. McKillop; Michael G. Gilman; George W. Hager, Jr.

[57] ABSTRACT

A rotary well drilling system employs a drill string with a drill bit affixed at its lower end for the drilling of a borehole. Drilling fluid is circulated through the drill string to remove drill cuttings. To break out a section of drill pipe from the drill string, the drill string is raised to a point where the drill string joint to be broken is above the drilling rig floor. Compressed gas is injected into the drill string to displace the column of drilling fluid to a level below such drill string joint. The compressed gas is vented and the drill pipe is broken out of the drill string.

13 Claims, 3 Drawing Figures

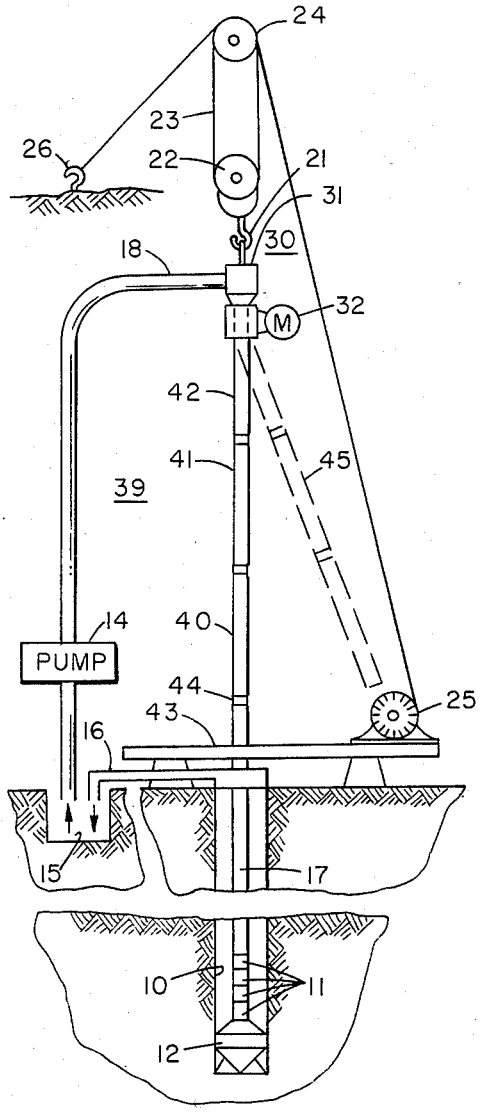
FIG. 1
FIG. 3
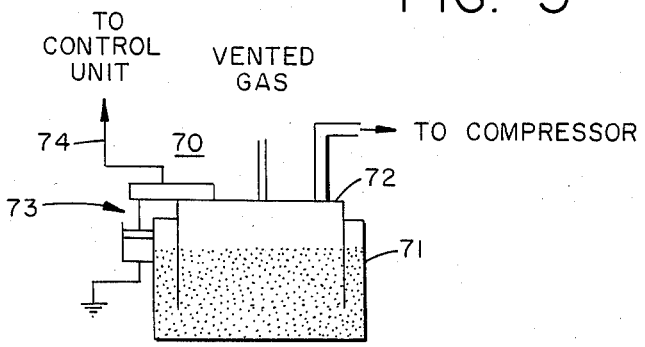

METHOD AND SYSTEM FOR DISPLACING DRILLING FLUID FROM A DRILL STRING IN A WELL DRILLING SYSTEM

BACKGROUND OF THE INVENTION

Drilling of oil wells has progressed from crude drilling rigs, to cable tool rigs, to the modern rotary drilling rigs. In rotary conventional drilling, a power rotating means delivers torque to a drill pipe which turns a bit drilling a borehole into the subsurface formations. The drill pipe is raised and lowered in the borehole from support means affixed to a conventional drilling rig. Suspended over pulleys positioned at the upper end or top of the rig are a plurality of cables which support a traveling block. Suspended from the traveling block is a swivel. The swivel is secured to a kelly which supports the drill pipe. The kelly is square or hexagonal in cross section over a substantial portion of its length and fits in sliding relation through a rotary table in the rig floor. The rotary table, driven by a suitable prime mover, serves to turn the kelly, thereby rotating the drill pipe. Due to the sliding fit between the kelly and the rotary table, the kelly slides downwardly through the rotary table as drilling progresses. While the power for rotating the kelly, and thus the drill pipe, is applied to the rotary table, the entire weight of the kelly and drill pipe is supported by the swivel which also functions to conduct drilling fluid to the kelly and drill pipe. Drilling fluid, generally from a mud tank or mud pit, passes through a hose into the swivel, downward through the drill pipe, and out through openings in the drill bit into the borehole. The drilling fluid then circulates upward from the drill bit, carrying formation cuttings through the annulus between the drill pipe and the borehole wall to the surface of the earth where it returns to the mud tank or pit. When it is necessary to add another section of drill pipe during drilling of the wellbore or to remove a section of drill pipe when pulling out of the borehole (i.e. tripping), the traveling block, swivel, and kelly are lowered or raised as needed by manipulation of the cables. Such a conventional drilling system is illustrated in U.S. Pat. Nos. 3,235,014; 3,324,717; 3,417,830; and 4,114,435.

Recent developments in drilling technology have replaced the conventional kelly and rotary table drive system with a power swivel employing an electric drive system for directly rotating the drill pipe. The power swivel is suspended from the traveling block and is fully compatible with the derricks or masts of the conventional drilling rig as well as the hoisting and electrical power systems of such rigs. One such top drive drilling system, or power swivel, is manufactured and supplied by Varco Drilling Systems, a Varco International, Inc. company, 800 N. Eckhoff Street, Orange, Calif. 92668. Such system is illustrated and described in conjunction with well drilling operations in an article entitled "New Power System Looks Promising," *Drilling Contractor*, March 1983, an official publication of the International Association of Drilling Contractors.

SUMMARY OF THE INVENTION

In accordance with the present invention, there is provided a method and system for breaking out at least one section of drill pipe from a drill string employed in the rotary drilling of a wellbore. The drill string is pulled out of the wellbore until the drill string joint which is to be broken for the removal of the section of drill pipe from the drill string is above the drilling rig floor. Compressed gas is injected into the top of the drill string to displace the drilling fluid in that portion of the drill string above the drill string joint which is to be broken. The compressed gas is injected into the drill string such that the gas acts in piston-like manner on the top of the drilling fluid column to lower its level in the drill string. The injection of compressed gas is stopped when the drilling fluid has been displaced to a level below such drill string joint. The compressed gas is then vented from the drill string and the drill pipe is broken out from the drill string. The vented gas may be recompressed and stored for use in subsequent drill string breakouts. Prior to recompression the vented gas is passed through a gas/liquid separator to remove any drilling fluid which may have clung to the drill string during drilling fluid displacement and which has been vented out of the drill string along with the compressed gas.

In a further aspect, the compressed gas is injected into the drill string through an inner tube such that the gas bubbles up through the column of drilling fluid and ejects mud from the top to lower the level of the mud in the drill string.

In a yet further aspect, rotary torque is supplied to the drill string from a top drive drilling motor which rotates the drill string continuously during pullout of the drill string and the drilling fluid is also continuously circulated during pullout. Drilling fluid circulation is stopped before injection of the compressed gas.

BRIEF DESCRIPTION OF THE DRAWINGS

FIG. 1 illustrates a well drilling system with which the method and system of the present invention may be used.

FIG. 3 illustrates a gas holding tank which may be utilized as a part of the system illustrated in FIG. 2.

DESCRIPTION OF THE PREFFERED EMBODIMENT

Figure 2:
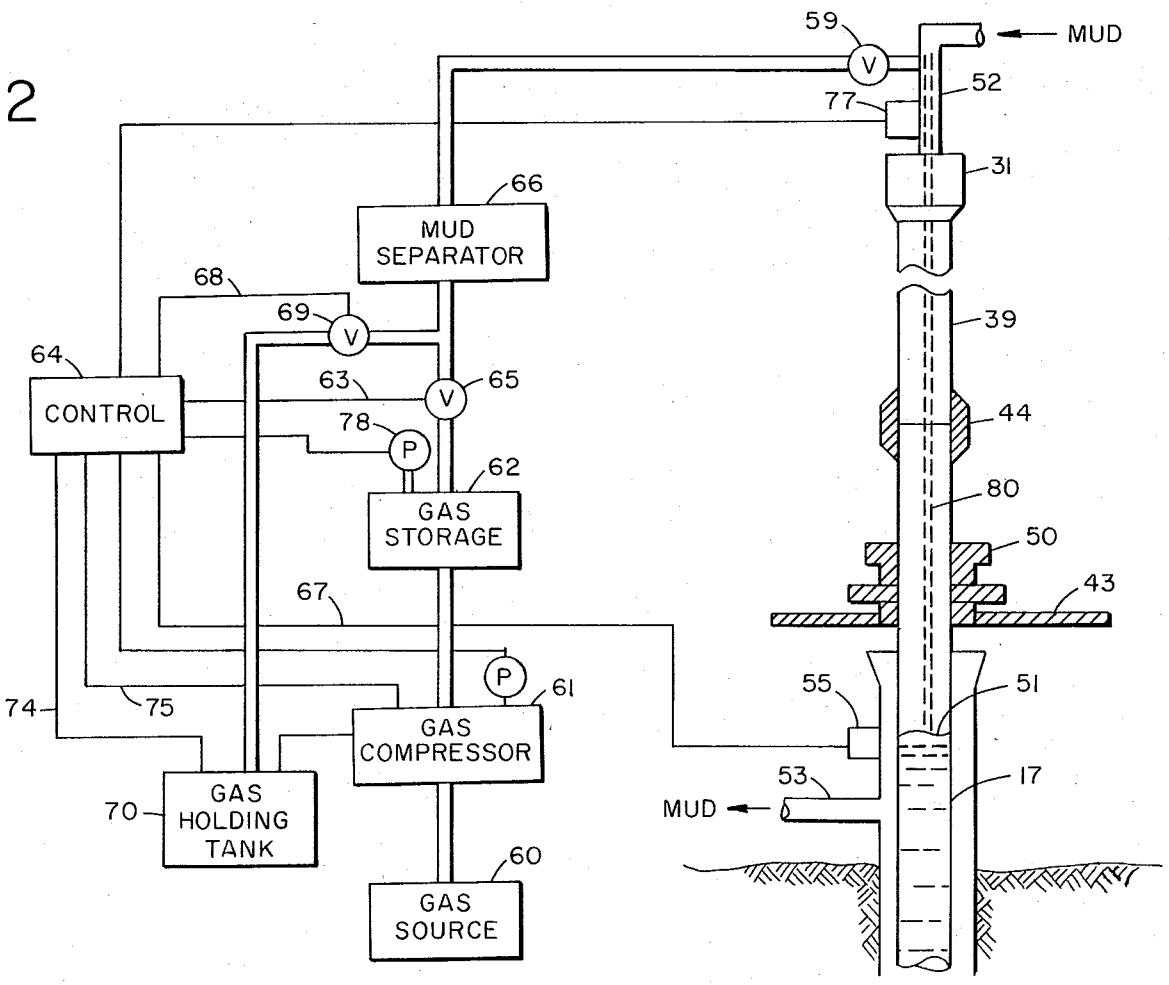
FIG. 2 illustrates the method and system of the present invention of displacing drilling fluid in the drill string of the well drilling system of FIG. 1 prior to breakout of a portion of the drill string.

One of the several advantages of the top drive drilling system over the kelly and rotary table drilling system is the ability to rotate the drill pipe and circulate the drilling fluid when tripping in or out of the borehole. This ability to rotate and circulate at any time while tripping provides significant time savings, especially where the potential for preventing sticking of the drill pipe in tight sections or high angle boreholes is greatly increased. However, when circulation is maintained during tripping, each section of drill pipe will be wet, that is full of mud, at breakout. A stand of three sections of drill pipe, normally in 30-foot sections, is tripped out of the borehole and the bottom joint of the stand broken, considerable drilling fluid spillage from the broken connection onto the rig floor can be expected. More particularly, a 90-foot stand of four inch inside diameter drill pipe contains as much as 1.4 barrels of drilling fluid, usually a drilling mud. The present use of special containers (i.e., mud boxes or mud buckets) to catch this mud spillage is time consuming and completely inadequate. The resulting mud spillage can cause loss of time, severe safety hazards, bad working conditions, inefficiency and loss of expensive mud. These adverse conditions are amplified by the use of oil-base muds. It is therefore the specific feature of the present invention to provide for a method and system by which such mud spillage is completely avoided when drilling with a top drive drill system, such invention being hereinafter described in conjunction with FIGS. 1 and 2.

Referring now to FIG. 1, there is shown a well 10 being drilled in the earth by rotary drilling. A drill string 17 is suspended within the well 10, and includes, at its lower end, a plurality of drill collars 11 and a drill bit 12. A top drive drill system 30, including a swivel 31 and driving motor 32, rotates the drill string 17. Generally, the drill string 17 is held in tension and only the weight of the drill collars 11 or less is allowed on the drill bit 12. Hence, a major portion of the load is borne by the hook 21 attached to the traveling block 22. The traveling block is moved by multiple windings of cable 23 between it and a crown block 24. One end of the cable 23, the so-called "dead line," is held by a dead line anchor 26. The other end of the cable 23 is fastened to the drum 25 of the drawworks and is wound onto it by rotation of that drum. To achieve less or more weight on the drill bit 12, the traveling block 22 is raised or lowered to take more or less of the weight of the drill collar 11. Simultaneously with the rotation of the drill string 17, a drilling fluid from a mud tank or pit 15 is circulated by a drilling fluid pump 14 through the line 18 into the swivel 31 and hence, into the drill string 17. The drilling fluid flows down through the drill string 17 and out through openings in the drill bit 12 into the well 10. The drilling fluid then circulates upward from the drill bit 12, carrying formation cuttings through the annulus between the drill string 17 and the well 10 to the surface of the earth. A line 16 returns the drilling fluid from the well 10 to the pit 15.

The drill string 17 is illustrated as being pulled out of the well during tripping operations such that a stand 39 of three drill pipe sections 40–42 are above the rig floor 43. At this point, the stand 39 is to be broken out of the drill string 17 at the joint 44. However, drilling fluid fills the entire stand 39 and will spill out onto the rig floor when the joint 44 is broken. A conventional 90-foot stand of 4-inch inside diameter drill pipe has a capacity of 1.4 barrels of drilling fluid which amounts to as much as 155 barrels of drilling fluid in tripping out of a well from 10,000 feet. It is therefore the specific feature of the present invention to lower the level of the drilling fluid in drill string 17 below the joint 44 before it is unscrewed from the drill string by injecting compressed gas into the top of stand 39 so that the gas displaces the mud to at least a level below joint 44. Thereafter the stand can be broken out, as shown by dashed lines 45, with no drilling fluid spillage excepting for that which clings to the inside surface of the pipe. The method and system for carrying out this feature of the invention is illustrated in FIG. 2.

Referring now to FIG. 2, the stand 39 of drill pipe is to be broken out from the drill string 17 at the joint 44 just above the slips 50 in the rig floor 43. In order to lower the fluid level in the drill string 17 to a point below the joint 44, such as to the fluid level 51, mud circulation through inlet line 52 and return line 53 is stopped, valve 59 is opened, and compressed gas is forced into line 52 through valve 59 to displace the drilling fluid in the stand 39. A liquid level sensor 55, or other alternative means, is utilized to determine when the drilling fluid has been completely displaced from the stand 39. At this time the compressed gas is vented from the drill string 39 and the drill string joint 44 is broken without any significant drilling fluid spillage.

An automated system for controlling the supply of compressed gas to the stand 39 is also shown in FIG. 2. A gas source 60 supplies a compressor 61. Air would be the preferred gas unless the nature of the drilling fluid is such that the presence of air creates a problem. Natural gas and nitrogen are suitable alternatives. Upon compression the gas is stored in a compressed gas storage tank 62. It can be appreciated that the gas source 60 and compressor 61 may be combined into a single unit such as a compressed gas cyclinder or cylinders. About 190 standard cubic feet of compressed gas at 300 psig pressure will be required to displace the drilling fluid from a 90-foot stand of 4 inch inside diameter drill pipe. When it is time to breakout the stand 39, a signal is sent by way of line 63 from control unit 64 to a valve 65. This signal causes valve 65, which is otherwise closed, to open and supply compressed gas through a mud separator 66 and valve 59 to the swivel 31. From swivel 31 the compressed gas enters the top of stand 39 and displaces the drilling fluid to a desired level below the joint 44 at which the stand 39 is to be broken out. The mud separator 66 functions when the compressed gas is vented out of the stand 39 and will be described later on. The level to which the drilling fluid is displaced is not important only so long as it is below joint 44. A liquid level sensor 55 is illustrated adjacent the drill string below the rig flooring 43. When the drilling fluid level reaches this point, sensor 55 sends a signal over line 67 to the control unit 64 which operates to close valve 65 and shut off the supply of compressed gas to stand 39. At the same time, control unit 64 sends a signal over line 68 to open the otherwise closed valve 69. This allows the gas to be vented out of the top of stand 39, through valve 59, mud separator 66 and valve 69 into a gas holding tank 70. As mentioned earlier, the drilling fluid has been displaced from stand 39 excepting for some residue film that clings to the inside walls of the drill pipe. Some of this residue may be carried out of the top of stand 39 along with the venting of the gas. It is the function of mud separator 66 to separate out this drilling fluid so that only the gas is vented all the way to the gas holding tank 70. Compressor 61 begins to recompress the vented gas, now in gas holding tank 70. The recompressed gas is stored in gas storage 62 for subsequent use with a later drill stand breakout operation.

In one embodiment, the gas holding tank 70 is a conventional bell-type holder as shown in FIG. 3. A first tank 71 has inserted within it a second inverted tank or bell tank 72. The first tank 71 is filled with a liquid, preferably water, to a level as shown in FIG. 3. As vented gas enters the inverted or bell tank 72, the bell tank begins to rise and opens the otherwise closed liquid level switch 73. This signals the control unit 64 over line 74, which in turn, signals compressor 61 over line 75 to load, i.e. start recompressing the vented gas now being collected. When all the vented gas has been recompressed, the bell tank 72 has lowered to a position to close switch 73. This signals control unit 64 to unload compressor 61 since all the vented gas has now been compressed.

In describing the operation of the preferred embodiment of FIG. 2, a liquid level sensor 55 has been illustrated for detecting when the drilling fluid has been displaced below the drill stand breakout point at joint 44. One such sensor may be a conventional mechanical-sonic type sensor which uses an electromechanical device to strike the drill string 17 on one side while a sonic sensor on the other side of the drill string monitors the sound frequency or intensity to detect the passage of the drilling fluid level. Another liquid level sensor that would be suitable is set forth in U.S. Pat. No. 4,391,135 to Godbey et. al. This sensor would be positoned at the top of the stand 39, as shown at 77. Acoustic pressure pulses are transmitted from sensor 77 down the drill pipe and reflected by the drilling fluid level 51. The travel time of the reflected pulses is measured by the sensor 77 as an indication of the depth to which the drilling fluid has been displaced.

An alternative method to that of measuring the depth of the drilling fluid level 51 is to measure the volume of the displacing compressed gas required to lower the drilling fluid level below the breakout joint 44 of the 90-foot stand 39 of drill pipe. For example, a pressure sensor 78 monitors the pressure of the compressed gas in the gas storage unit 62. During displacement of the drilling fluid, the pressure in gas storage unit is lowered. Since the volume of the gas storage unit is known, the final pressure expected upon complete displacement of the drilling fluid from the 90-foot stand 39 of drill pipe can be predetermined. When pressure sensor 78 reaches this predetermined pressure, control unit 64 operates to close valve 65 and terminate the drilling fluid displacement operation.

The drilling fluid displacement operation described above in conjunction with FIG. 2 relates to injecting compressed gas into the top of the stand 39 of drill pipe such that such gas acts with a piston-like force on the top of the column of drilling fluid, thereby lowering its level so long as the injection of compressed gas continues. An alternative method to this above-described method involves the insertion of a tube through the top of stand 39 to a point below the breakout joint 44 as shown by the dotted lines at 80. The compressed gas is forced through the tube 39 into the drilling fluid below joint 44. The gas then bubbles up through the fluid, thereby reducing fluid density and lowering the level of the fluid. Such gas injection continues until the fluid level is identified as falling below the joint 44 by one of the several above-described liquid level sensing methods.

Having now described the present invention in connection with a preferred embodiment, it is to be understood that various modifications and changes may be made without departing from the spirit and scope of the invention as set forth in the appended claims.

We claim:

1. In the rotary drilling of a wellbore with a drill string, formed with a plurality of sections of drill pipe, and having a drill bit at the lower end thereof, the method of disconnecting and breaking out at least one section of drill pipe from said drill string at a select drill string joint with minimized drilling fluid spillage, comprising steps of:

(a) pulling the drill string out of the wellbore, (b) continuously rotating the drill string with a top drive drilling motor and circulating drilling fluid through said drill string while said drill string is being pulled from the wellbore, (c) stopping said drill string rotation and said drilling fluid circulation when a select drill string joint is above the drilling rig floor, (d) injecting compressed gas into the drill string to displace the drilling fluid in that portion of the drill string above said select drill string joint, (e) stopping the injection of compressed gas into the drill string when the drilling fluid level has fallen below said select drill string joint, and (f) breaking out that portion of the drill string above said selected drill string joint.

2. The method of claim 1 wherein the compressed gas is injected into the drill string through an inner tube such that the gas bubbles up through the column of drilling fluid and lowers its density and level in the drill string.

3. The method of claim 1 wherein the drilling fluid level in the drill string is identified from the position of the gas/fluid interface.

4. The method of claim 1 wherein the drilling fluid level in the drill string is identified by a measure of the volume of compressed gas injected into the drill string.

5. The method of claim 1 further including the steps of:

(a) venting said compressed gas from the drill string prior to the breaking out of said drill string at the select drill string joint, and (b) recompressing and storing said vented gas for use in subsequent drill string breakouts.

6. The method of claim 5 further including the step of separating any drilling fluid from the vented gas prior to recompression which may have clung to the wall of the drill string above the select drill string joint during the injection of the compressed gas into the drill string.

7. A method for breaking out at least one section of a drill pipe from a drill string in a well drilling operation in which the drill string is supported from a drilling rig and has a drill bit affixed to its lower end for drilling into the subsurface formation below the drilling rig, comprising:

(a) supplying rotary power to the top of the drill string, (b) circulating drilling fluid through the drill string to clean the drill bit and the borehole of drill cuttings, (c) pulling said drill string out of the borehole while continuing the supplying of rotary power or the circulating of drilling fluid until a select drill string joint which is to be broken for the removal of at least one drill pipe section from the drill string is above the rig flooring, (d) terminating the circulating of drilling fluid, (e) injecting compressed gas into the top of said drill string to displace the drilling fluid downwardly through the drill string, (f) monitoring the downward displacement of the drilling fluid through the drill string, (g) terminating the injecting of compressed gas when the drilling fluid has been displaced downwardly through the drill string to a position below the select drill string joint at which said at least one drill pipe section is to be broken out from the drill string, (h) venting the compressed gas from the drill string, (i) separating any drilling fluid from the vented gas which may have been vented along with the gas, (j) collecting the drilling fluid free vented gas in a gas holding tank, (k) supplying said vented gas to a gas compressor for recompressing said gas as it is being collected in said gas holding tank, (l) sensing the volume of gas in said gas holding tank and terminating the recompressing of said gas when the gas volume in said holding tank reaches a minimum level, (m) storing siad recompressed gas, (n) breaking out said at least one drill pipe section from the drill string at said select drill string joint, and (o) repeating steps (a) through (n) for the subsequent breakout of other drill pipe sections from said drill string.

8. In a well drilling system wherein a power rotating means delivers torque to rotate a drill string suspended from a traveling block moving in response to movement of a cable arranged over multiple sheaves mounted in a crown block, the drill string turns a bit drilling a borehole into subsurface formations and a drilling fluid is circulated to keep the bit and bottom of the borehole cleaned of cuttings, a system for breaking out a portion of the drill string which has been pulled out of the well after drilling operations, comprising:

(a) a source of compressed gas, (b) a first valve which is opened to allow compressed gas from said source to be injected into the drill string, (c) means for sensing the level of the drilling fluid into the drill string as the ompressed gas displaces the drilling fluid, (d) means for closing said first valve to stop the injection of compressed gas into the drill string when the sensing means indicates the drilling fluid level to be below that portion of the drill string which is to be broken out, (e) a second valve which is opened following the closing of said first valve to vent the compressed gas from the drill string, and (f) means for breaking out said portion of the drill string upon the completion of the venting of said compressed gas.

9. The system of claim 8 further including:

(a) a gas/liquid separator for separating any drilling fluid from the vented gas which may have vented with the gas, and (b) means for recompressing said vented gas for use in subsequent drill string break out operations.

10. The system of claim 8 wherein said sensing means, positioned adjacent the drill string below that portion which is to be broken out, injects acoustic energy transversely through the drill string, and detects the frequency or intensity of said acoustic energy after it has traveled transversely through the drill string, a change in the detected frequency or intensity indicates the passage of the interface between the injected gas and the displaced drilling fluid.

11. The system of claim 8 wherein said sensing means is a pressure sensor which provides a signal proportional to the volume of compressed gas injected into the drill string, said first valve being closed when the volume of compressed gas required to displace the drilling fluid below that portion of the drill string to be broken out has been injected into the drill string.

12. The system of claim 8 wherein said sensing means is positioned at the top of said drill string and detects the travel time of acoustic energy which travels down the drill string and is reflected from the interface between the injected gas and the displaced drilling fluid, such detected travel time indicating the level of said interface in the drill string.

13. The system of claim 8 further including a tube inserted in the top of the drill string and extending at least to the drill string joint at which the drill string is to be broken out, the compressed gas being injected into the drilling fluid through said tube and bubbling up through said drilling fluid, lowering its density and fluid level in the drill string.

* * * * *